United States Patent [19]

Zamboni

[11] 4,069,540

[45] Jan. 24, 1978

[54] MACHINE FOR REMOVING PAINTED STRIPES FROM ARTIFICIAL TURF

[75] Inventor: Frank J. Zamboni, Paramount, Calif.

[73] Assignee: Frank J. Zamboni & Co., Paramount, Calif.

[21] Appl. No.: 705,023

[22] Filed: July 14, 1976

[51] Int. Cl.[2] ..... A47L 7/00

[52] U.S. Cl. ..... 15/320; 15/340; 15/359

[58] Field of Search ..... 15/320, 321, 340, 345, 15/346, 401, 421, 359

[56] References Cited

U.S. PATENT DOCUMENTS

| | | | |
|---|---|---|---|
| 953,825 | 4/1910 | Gekeler | 15/421 |
| 1,268,962 | 6/1918 | Gray | 15/320 X |
| 3,431,582 | 3/1969 | Grave | 15/321 |
| 3,699,607 | 10/1972 | Putt | 15/320 |
| 3,736,619 | 6/1973 | Zamboni | 15/320 X |
| 4,000,536 | 1/1977 | Nayfa et al. | 15/320 X |

*Primary Examiner*—Christopher K. Moore
*Attorney, Agent, or Firm*—Kidder Herbert E.

[57] ABSTRACT

A machine for removing painted stripes from artificial turf, comprising an automotive vehicle carrying an engine-driven blower, water pump, water tank, and a conditioner head that is flexibly connected to the vehicle and slides on the turf. The conditioner head includes an open-bottom housing that is spring-pressed down against the turf so that there is virtually no clearance under the bottom edges of the housing. The blower pulls a vacuum inside the water tank, and the latter is connected by hoses to the conditioner housing. A rotary brush inside the housing scrubs the turf to scour away previously-softened stripe paint. Behind the brush is a nozzle that directs a high pressure spray of water down into the turf to wash away the loosened paint particles, and this is followed by a roller that presses down against the turf and rolls water ahead of it. A baffle just ahead of the roller provides restricted clearance under its bottom edge for the water to flow under it, and this baffle forms the front wall of a chamber enclosing the roller, to which the vacuum suction hoses are connected. Water is sucked up by the vacuum and discharged into the water tank, where it is filtered and returned to the water pump. A rubber flap seal at the front end of the housing bears downwardly against the turf and upwardly against the underside of the housing to provide a yieldable air seal that allows a restricted flow of air into the housing when there is sufficient vacuum pressure inside the housing to overcome the resistance of the flap.

4 Claims, 8 Drawing Figures

FIG. 3.
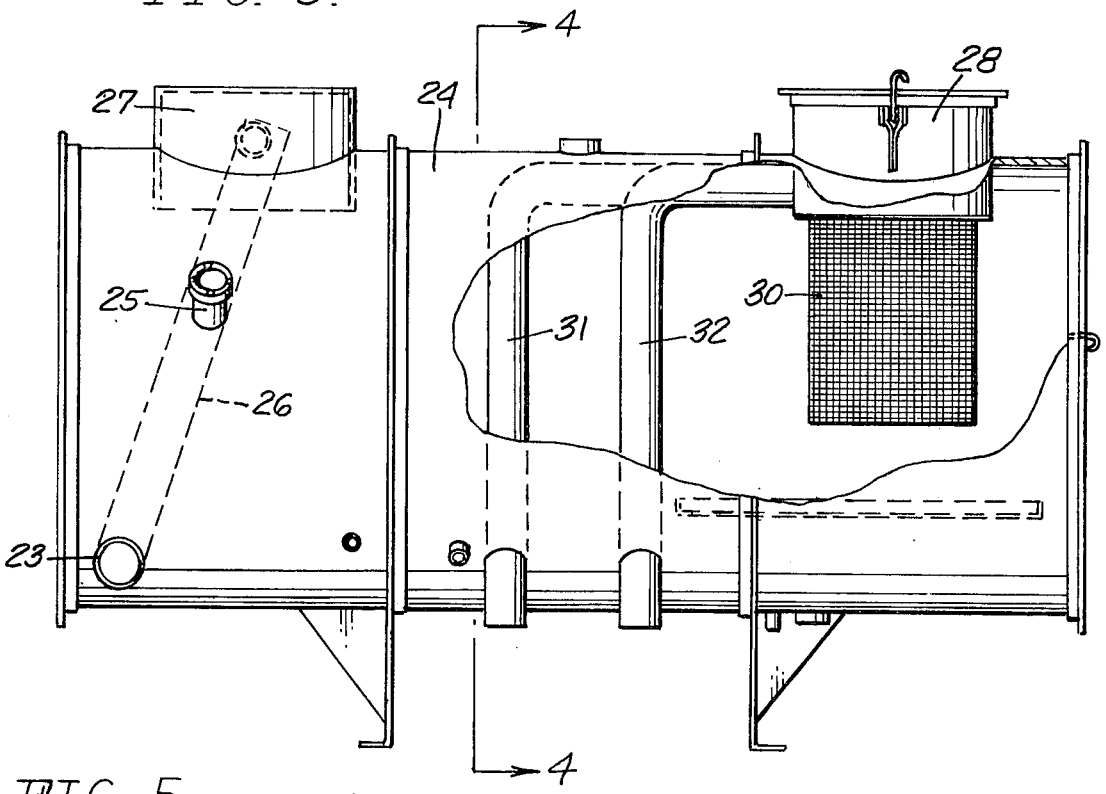
FIG. 5.
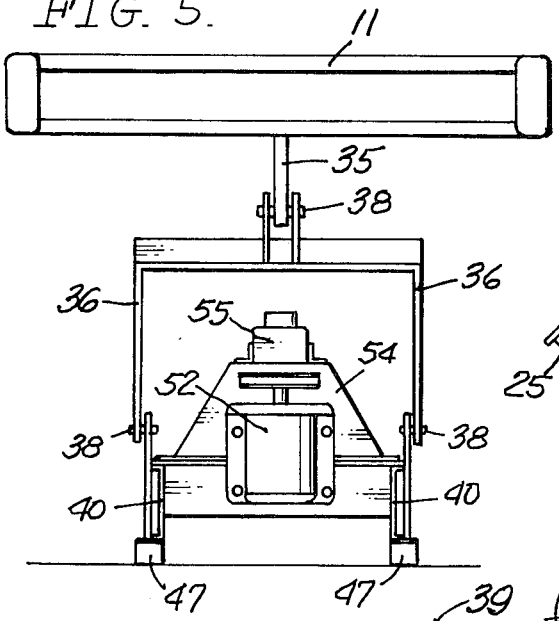
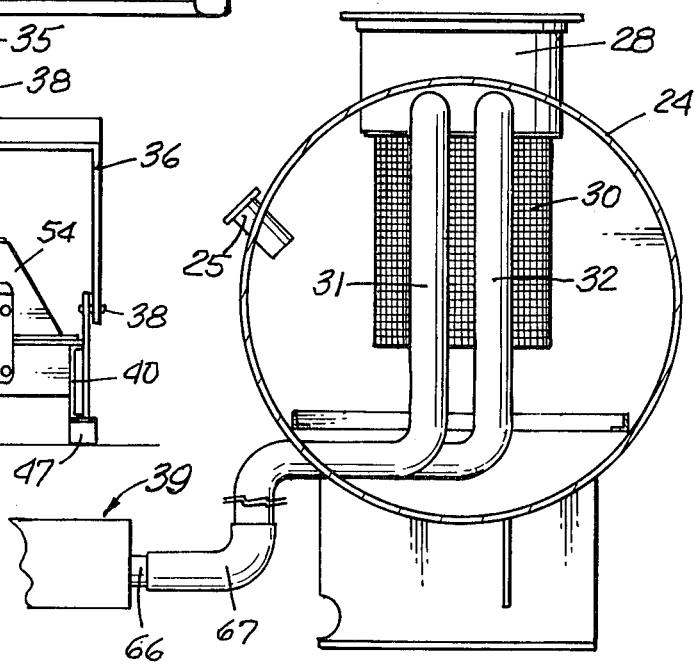
FIG. 4.

MACHINE FOR REMOVING PAINTED STRIPES FROM ARTIFICIAL TURF

BACKGROUND OF THE INVENTION

As indoor and outdoor athletic fields turn increasingly to the use of artificial turf to cover the ground, it has become necessary to remove the painted stripes or field markings that are applied to the turf for one event, and replace them with entirely new stripes or field markings for another, different event. Typical of the field markings are the 5-yard lines on a football field. These stripes are painted onto the turf with a paint that is softened by ammonia, and it has usually been necessary for employees to wet down the stripes with ammonia, after which the softened paint has been scrubbed by hand and hosed off. This is a tedious, time-consuming and expensive way to remove the stripes, and it is virtually impossible to avoid leaving a grey film on the green-colored turf, owing to the fact that much of the loosened paint particles are left behind on the fibers of the turf.

SUMMARY OF THE INVENTION

The primary object of the present invention is to provide a new automotive machine that scrubs the ammonia-loosened paint, washes the dislodged paint particles out of the turf, and vacuums up the rinse water and suspended paint particles, all in one pass of the machine, leaving a perfectly clean and only slightly damp turf behind it. The machine requires only a single operator, who drives it slowly over the field markings, working from one end of the field to the other.

Another object of the invention is to provide a machine of the class described that is completely self-contained and, at the same time, light enough in weight so that it will not damage the artificial turf when driven over it.

These and other objects are advantages of the invention will become apparent to those skilled in the art from the following detailed description of the preferred embodiment thereof, with reference to the accompanying drawings.

BRIEF DESCRIPTION OF THE DRAWINGS

FIG. 3 is a partially cut-away view of the vacuum tank, showing some of the internal structure;

FIG. 4 is a transverse sectional view through the vacuum tank, taken at 4—4 in FIG. 3;

FIG. 5 is a front elevational view of the conditioner head;

Figure 1:
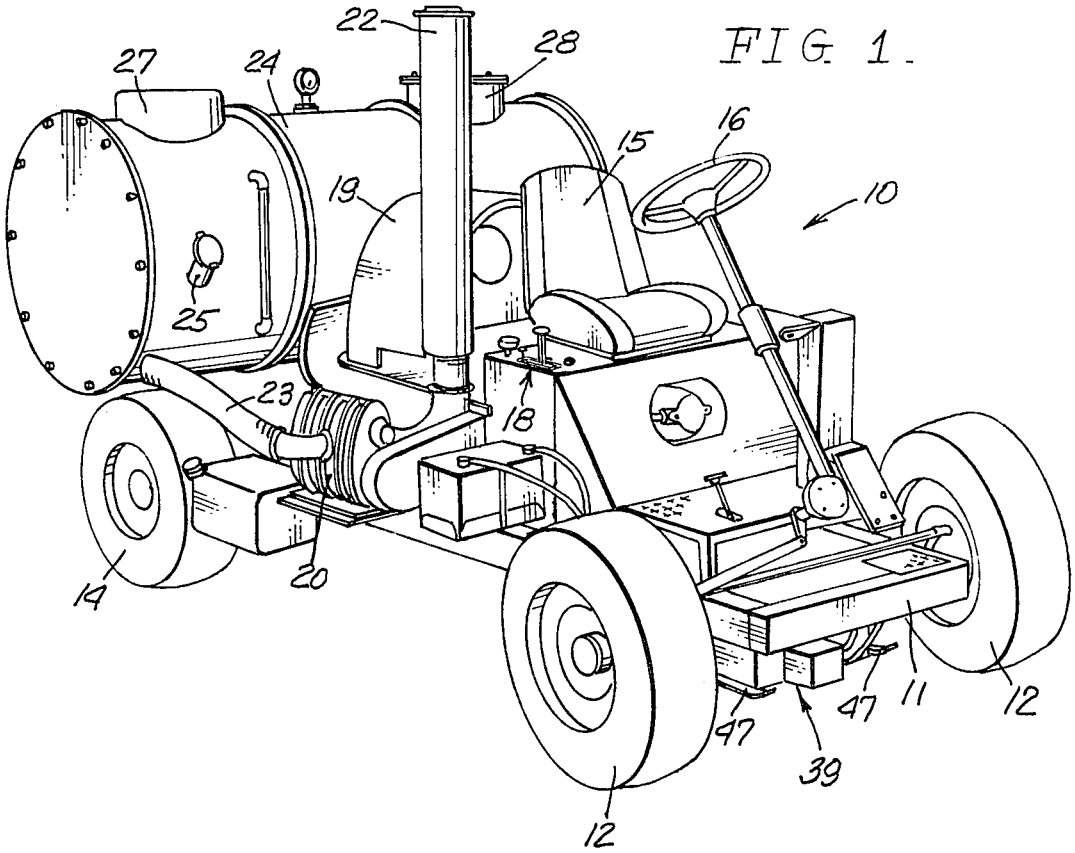
FIG. 1 is a perspective view of a machine embodying the invention, showing the right-hand side of the machine as seen from in front.
Figure 2:
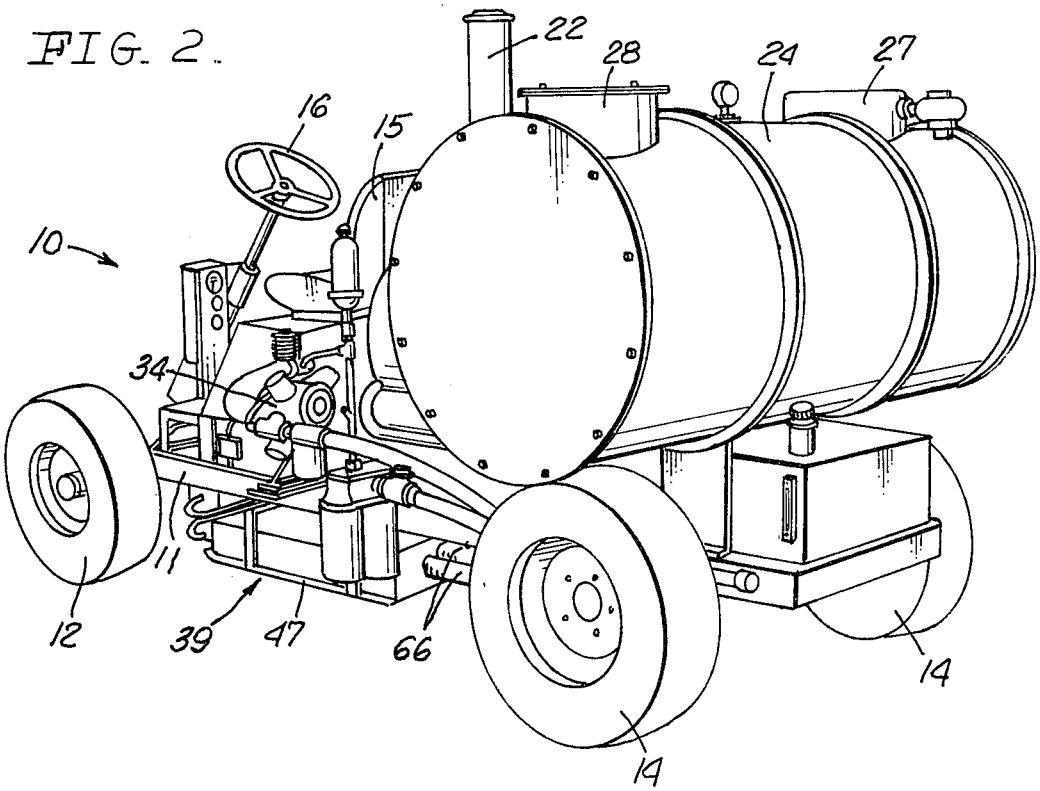
FIG. 2 is another perspective view of the same, showing the left-hand side, as seen from behind.

DESCRIPTION OF THE PREFERRED EMBODIMENT:

In the drawings, a machine constructed in accordance with this invention is designated in its entirety by the reference numeral 10. As seen in FIGS. 1 and 2, the machine is an automotive vehicle comprising a frame 11, supported on steerable front wheels 12 and power-driven rear wheels 14. Mounted on top of the machine near the front end thereof is an operator's seat 15 and steering wheel 16, with controls 18 conveniently arranged alongside the operator's seat. Behind the operator's seat 15 is a hood 19 that encloses an internal combustion engine (not shown), which drives a variable displacement hydrostatic pump (not shown). The hydrostatic pump supplies high pressure hydraulic fluid to the several hydrostatic motors on the machine, including one that drives the rear wheels 14. Also belt-driven by the engine is a positive displacement lobe-type blower 20, the exhaust of which goes into a silencer 22. A suction line 23 connects the intake of the blower 20 to the interior of a vacuum tank 24 mounted transversely across the frame of the vehicle at the rear end thereof. Tank 24 has a fill pipe 25, by means of which the tank can be partially filled with fresh water at the start of the stripe-removing operation, as will be explained in more detail later.

FIG. 3 shows an intake pipe 26 that passes through the wall of the vacuum tank 24 near the bottom thereof and turns upwardly, terminating just below the top of a turret 27 at one end of the vacuum tank. Another turret 28 at the other end of the tank has cylindrical side walls that extend down into the tank for a short distance, and attached to the bottom edge of the side walls is a filter basket 30. Two discharge pipes 31 and 32 discharge through the depending side walls of the turret 28 into the filter basket 30, and foreign matter suspended in the water picked up through the pipes 31, 32 is separated out by the filter basket 30, while the filtered water drains to the bottom of the tank.

Mounted on the vehicle frame 11 alongside the driver's seat on the left-hand side thereof is a high-pressure water pump 34, which is beltdriven by the internal combustion engine under the hood 19. The intake of the pump 34 is connected by flexible hose to the inside of the tank 24 near the bottom thereof. The discharge side of the pump is connected to a spray nozzle in the conditioner head, which will be described presently.

Two fore-and-aft spaced brackets 35 project downwardly from the underside of the vehicle frame 11 along the centerline thereof, and connected to these brackets by rearwardly trailing parallel links 36 and pivot pins 38 is a conditioner head 39, which does the work of removing the painted stripes from the artificial turf. The conditioner head 39 comprises a housing in the form of a shallow, rectangular box which is open at the bottom, with side walls 40, front wall 42 and top wall 43. The rear end of the housing is made up of two transverse structural members 44 and 46, arranged one over the other. Fixed to the bottom edges of the side walls 40 are full-length runners 47 that slide on the turf. Rotatably supported in bearings 48 mounted on the top wall 43 of the housing is a brush 50, the bristles of which extend a short distance below the bottom surface of the runners 47 so that they penetrate down into the fibers of the artificial turf. Brush 50 is driven by a belt 51 and hydrostatic motor 52 mounted on the front wall 42, the said motor being supplied with hydraulic fluid by the pump which is driven by the internal combustion engine.

Mounted on top of the housing a short distance behind the brush 50 is an upwardly extending nozzle housing 54 which supports a nozzle 55 that is connected by high pressure water hose to the discharge port of pump 34. Nozzle 55 is designed to discharge a fan-shaped spray of water at high pressure (e.g., of the order of 600 psi) down into the fibers of the artificial turf so as to dislodge and wash out the paint particles that have been scrubbed off by the brush. An opening 56 is provided in the top of the housing 54, through which the spray discharged by nozzle 55 passes.

Figures 6, 7, 8:
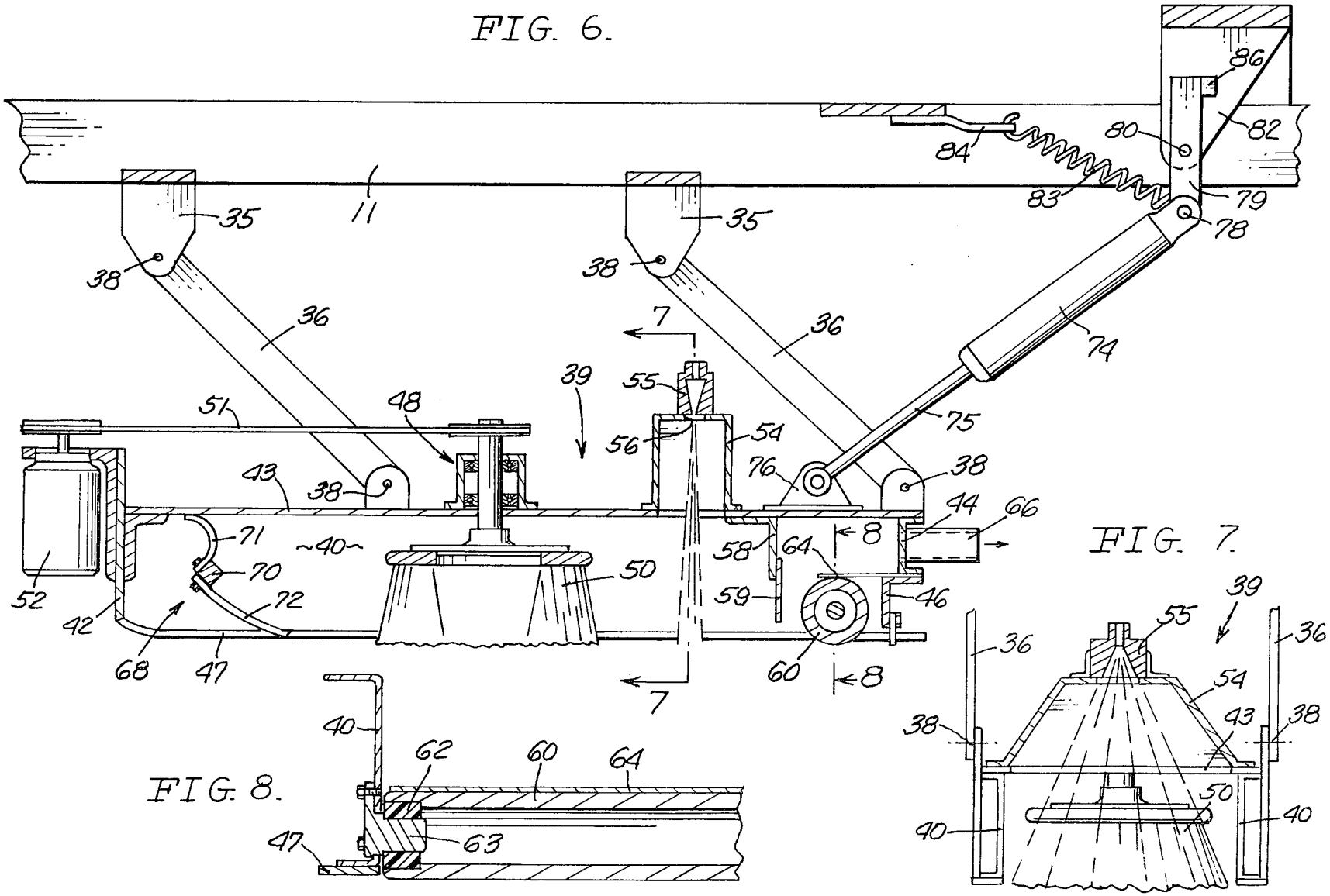
FIG. 6 is an enlarged, fragmentary side elevational view of the conditioner head, the housing of which has been sectioned down the middle to show details of the mechanism in the interior.
FIG. 7 is a transverse sectional view through the conditioner head, taken at 7—7 in FIG. 5.
FIG. 8 is an enlarged fragmentary sectional view taken at 8—8 in FIG. 5.

Fixed to the underside of the housing top wall 42 is a transversely extending angle iron 58, and attached to the depending flange of the angle iron is a baffle 59. The bottom edge of baffle 59 is spaced a short distance above the surface of the turf, leaving a narrow slit through which air flows at high velocity as it is sucked to the rear end of the housing by the suction pipes. Behind the baffle 59 is a transversely disposed roller 60 having nylon bearings 62 pressed into its ends, as shown in FIG. 8, and these bearings turn on journals 63, which are attached to the side walls 40. Roller 60 thus extends from one side of the housing to the other. Bearing lightly against the top surface of the roller 60 is a thin plate 64, the right-hand edge of which is clamped between members 44 and 46. The purpose of the plate is to seal the space behind the roller 60, so that air will not enter the housing under the bottom edge of member 46.

Two suction pipes 66 open into the interior of the conditioner head 39 at the rear end thereof, and these are connected by flexible vacuum hose 67 to discharge pipes 31, 32. Thus, the entire suction produced by blower 20 is applied to the interior of the conditioner head 39, drawing air at high velocity under the bottom edge of the baffle 59 and out through suction pipes 66 and hose 67 to the vacuum tank 24.

The bottom of roller 60 extends below the bottom surface of runners 47, and the roller is thus pushed down into the artificial turf, squeezing water out of the turf and forming a wave of excess water ahead of the roller. This wave of water is picked up by the high velocity stream of air passing under the baffle 59, and the water is broken up into droplets that are picked up and carried along by the air stream.

To provide a controllable, restricted flow of air through the conditioner head housing, an adjustable flexible seal 68 is provided near the front end of the housing, consisting of a rotatably adjustable transverse shaft 40, to which an upper flap 71 and lower flap 72 are attached. Upper flap 71 extends upwardly from shaft 70 and is curved forwardly, with its extremity pressing against the underside of housing top wall 43. Lower flap 72 extends downwardly and rearwardly from the shaft 70 and its extremity presses downwardly against the surface of the artificial turf. Both flaps 71 and 72 are made of fairly stiff, resilient material, so that considerable force is required to bend the flaps. When the vacuum pressure inside the housing reaches a certain point, the differential pressure on flap 72 causes the flap to lift up slightly so that air can enter the housing. At the same time, differential pressure acting on upper flap 71 causes the latter to press tightly against the underside of top wall 43. Thus, the amount of air entering the housing depends upon the vacuum pressure inside the housing and the amount of deflection of the flap 72. If it is desired to increase the resistance offered by flap 72, shaft 70 would be turned an appropriate number of degrees in the clockwise direction, causing both of the flaps 71, 72 to bend more acutely and thereby increase the resistance to being lifted by the differential pressure.

The conditioner head 39 is yieldingly held down against the turf by means of a hydraulic cylinder 74 having a piston rod 75 that is connected to a bracket 76 on the top of conditioner head 39. The other end of the cylinder 74 is connected by a pin 78 to the bottom end of a lever 79. Lever 79 is connected by a pivot pin 80 to a bracket 82 extending downwardly from vehicle frame 11. A tension spring 83 has one end anchored to a bracket 84, and its other end is attached to the pin connecting cylinder 74 to the lever arm 79. Spring 83 exerts pull on the hinged joint, causing lever arm 79 to turn clockwise about pin 80 until its top end abuts against a limit stop 86. Since the parallel links 36 trail rearwardly from their points of attachment to brackets 35, any upward displacement of the conditioner head 39 due to irregularities in the surface of the turf would cause the piston rod 75 and cylinder 74 to be thrust rearwardly, turning the lever arm 79 counterclockwise about pin 80 against the tension of spring 83. As soon as the surface irregularity is passed, spring 83 pulls the lever 79 back against its limit stop 86, pushing the conditioner head 39 back down against the turf with its normal spring pressure. When the machine is to be transported from one location to another, cylinder 74 is actuated to retract piston rod 75, and this causes the conditioner head to be raised up from the ground.

The operation of the machine is as follows:

First, the painted stripes are sprayed with an ammonia solution which has the effect of softening and disintegrating the paint so that it can be more easily scoured off by the rotating brush 50. The ammonia solution can be sprayed on by means of a hand-held spray gun pumping three gallons per minute, carried by an operator walking at a slow pace of about 50 to 60 feet per minute. After the ammonia has has about 8 to 10 minutes' time to work on the paint, the operator should check the condition of the paint by rubbing his hand over the stripe to see if the paint has been properly softened by the ammonia. When the paint has been properly softened, the machine is driven slowly along the stripe so that the stripe is scrubbed by the brush 50, after which the high pressure water spray from nozzle 55 washes out the loosened paint particles. Finally, the surplus water and suspended paint particles are sucked up by the vacuum suction which pulls the air and water through the narrow slot under the bottom edge of baffle 59. Roller 60 presses downwardly on the turf with sufficient pressure so that no excess water is left in the turf.

While I have shown and described in considerable detail what I believe to be the preferred form of my invention, it will be understood by those skilled in the art that the invention is not limited to such details, but may take various other forms within the scope of the following claims.

What I claim is:

1. A machine for removing stripes or other markings from artificial turf, comprising:

an automotive vehicle having a vacuum tank mounted thereon, into which water is drawn from the turf, a blower connected to said vacuum tank so as to draw air therefrom, and a high-pressure water pump, the intake of which is connected to the bottom of said vacuum tank so as to draw water therefrom;

a conditioner head mounted on the underside of said vehicle so as to slide on the turf, said conditioner head including an open-bottom housing which cooperates with the turf to form an enclosed chamber;

a brush rotatably supported on said housing within said chamber, with its bristles engaging the surface of the turf;

means for driving said brush a nozzle mounted on said housing, fluidly connected to the outlet of said pump, and directing a high-pressure spray of water down into the turf adjacent said brush;

suction lines connecting the interior of said housing to said vacuum tank;

a roller journaled within said housing adjacent the rear end thereof, said roller bearing downwardly against the turf and acting to roll a wave of water ahead of itself; and means for confining the flow of air drawn in by said suction lines to a high velocity stream adjacent the surface of the turf ahead of the wave, so that the wave of water is picked up by the high velocity stream of air and is carried thereby.

2. The invention as set forth in claim 1 wherein said means for confining the flow of air comprises a baffle extending transversely across the width of the housing just ahead of said roller, the bottom edge of said baffle being spaced a short distance above the surface of the turf so that air drawn by said suction lines is forced to flow under the bottom edge of the baffle and through the wave of water rolled up by said roller.

3. The invention as set forth in claim 1, wherein means is provided for admitting a restricted flow of air into the enclosed chamber when the vacuum pressure within the chamber reaches a predetermined value, said means comprising a transverse shaft supported in the front end of said housing for rotational adjustment; upper and lower flaps of resilient material attached to said shaft, said upper flap curving upwardly and forwardly with respect to the line of travel, with its extremity bearing against the underside of the housing, and said lower flap extending downwardly and rearwardly, with its extremity bearing against the turf, whereby rotation of said shaft in one direction causes said upper and lower flaps to bear against their respective surfaces with increased pressure.

4. A machine for removing stripes or other markings from artificial turf, comprising:

an automotive vehicle having a vacuum tank mounted thereon, into which water is drawn from the turf, a blower connected to said vacuum tank so as to draw air therefrom, and a high-pressure water pump, the intake of which is connected to the bottom of said vacuum tank so as to draw water therefrom;

a conditioner head disposed beneath said vehicle and arranged to slide on the turf, said conditioner head including an open-bottom housing which cooperates with the turf to form an enclosed chamber;

link means connecting said housing to said vehicle whereby the housing can be raised or lowered between operating and transport positions;

a hydraulic cylinder connected to the free end of a spring-loaded link pivoted on said vehicle for swinging movement in the fore-and-aft direction said cylinder having a piston rod that is extended when the housing is in said working position sliding on the turf, and said piston rod being retractable to raise said housing to the transport position;

said spring-loaded pivoted link allowing said extended cylinder and piston rod to yield rearwardly under excessive pressure so as to allow the housing to yield rearwardly and raise slightly;

a brush rotatably supported on said housing within said chamber, with its bristles engaging the surface of the turf;

means for driving said brush;

a nozzle mounted on said housing fluidly connected to the outlet of said pump and directing a high-pressure spray of water down into the turf adjacent said brush;

suction lines connecting the interior of said housing to said vacuum tank; and means for accumulating the water discharged into the turf by said nozzle so that the water can be picked up by suction and carried through said suction lines to said vacuum tank.

* * * * *